US007638029B2

(12) United States Patent
Guilbault et al.

(10) Patent No.: US 7,638,029 B2
(45) Date of Patent: Dec. 29, 2009

(54) ELECTROLYTIC METHOD FOR PRODUCING BOROHYDRIDE

(75) Inventors: Lawrence James Guilbault, Boxford, MA (US); Edward Augustine Sullivan, Beverly, MA (US); Nancy Margaret Sullivan, legal representative, Beverly, MA (US); Norman Louis Weinberg, East Amherst, NY (US)

(73) Assignee: Rohm and Haas Company, Philadelphia, PA (US)

( * ) Notice: Subject to any disclaimer, the term of this patent is extended or adjusted under 35 U.S.C. 154(b) by 744 days.

(21) Appl. No.: 11/104,121

(22) Filed: Apr. 12, 2005

(65) Prior Publication Data

US 2005/0224364 A1 Oct. 13, 2005

Related U.S. Application Data

(60) Provisional application No. 60/561,603, filed on Apr. 13, 2004.

(51) Int. Cl.
*C25B 1/00* (2006.01)

(52) U.S. Cl. ..... 205/549

(58) Field of Classification Search ..... 205/549
See application file for complete search history.

(56) References Cited

U.S. PATENT DOCUMENTS

| | | | | |
|---|---|---|---|---|
| 3,734,842 | A | 5/1973 | Cooper | |
| 4,808,282 | A * | 2/1989 | Gregory | 205/420 |
| 4,904,357 | A | 2/1990 | Sharifian et al. | |
| 4,931,154 | A | 6/1990 | Hale et al. | |
| 6,497,973 | B1 * | 12/2002 | Amendola | 429/19 |

FOREIGN PATENT DOCUMENTS

JP 2003-247088 5/2003

OTHER PUBLICATIONS

Denkhaus et al., Electrolytic hydride generation (EC-HG)—a sample introduction system with some special features, Jul. 2001, J. Anal. At. Spectrom., vol. 16, pp. 870-878.*

Gyenge, et al., Electrosynthesis Attempts of Tetrahydridoborates, Journal of Applied Electrochemistry, vol. 28, pp. 1147-1151, (1998).

* cited by examiner

*Primary Examiner*—Arun S Phasge
(74) *Attorney, Agent, or Firm*—Kenneth Crimaldi

(57) ABSTRACT

A method for producing borohydride by causing current to flow in an electrolytic cell between an anode and a cathode, wherein a solution of trialkoxyborohydride is in contact with the cathode.

1 Claim, No Drawings

ELECTROLYTIC METHOD FOR PRODUCING BOROHYDRIDE

CROSS REFERENCE TO RELATED PATENT APPLICATIONS

This is a non-provisional application of U.S. Provisional Application Ser. No. 60/561,603 filed on Apr. 13, 2004.

The present invention is directed to a method for electrosynthesis of borohydride.

An electrolytic process for production of borohydride is disclosed in U.S. Pat. No. 3,734,842, to Cooper. However, the starting materials disclosed by Cooper are limited to various borate salts. Moreover, a study by E. L. Gyenge and C. W. Oloman, documented in *Journal of Applied Electrochemistry*, vol. 28, pp. 1147-51 (1998), demonstrated that the method of Cooper, as well as several other published electrosyntheses of borohydride, actually does not produce measurable amounts of borohydride.

The problem addressed by this invention is the need for an electrochemical synthesis of borohydride.

STATEMENT OF THE INVENTION

The present invention is directed to a method for producing borohydride. The method comprises causing current to flow in an electrolytic cell between an anode and a cathode, wherein a solution of a trialkoxyborohydride is in contact with the cathode.

The present invention is further directed to a method for producing borohydride. The method comprises steps of: a) causing current to flow in an electrolytic cell between an anode and a cathode, wherein a solution of a borate ester is in contact with the cathode, thereby producing a solution of a trialkoxyborohydride; and b) causing current to flow in a second electrolytic cell between a second anode and a second cathode, wherein the solution of trialkoxyborohydride is in contact with the second cathode.

DETAILED DESCRIPTION OF THE INVENTION

As used in this application, "borohydride" means the tetrahydridoborate ion, $BH_4^-$. The term "borate ester" refers to a trialkyl borate, $B(OR)_3$, wherein R is an alkyl group, optionally substituted by hydroxy or alkoxy, and preferably having from one to eight carbon atoms. In one embodiment, R is methyl or ethyl. A "trialkoxyborohydride" is an ion having the formula $BH(OR)_3^-$, where R is an alkyl group having from one to eight carbon atoms, preferably from one to six carbon atoms, more preferably from one to four carbon atoms. In one embodiment, R has one or two carbon atoms.

A trialkoxyborohydride can be reduced by electrolysis to borohydride, as described in the following equation for sodium trimethoxyborohydride (STB) and sodium borohydride (SBH)

$$NaBH(OCH_3)_3+6H^++6e^-\rightarrow NaBH_4+3CH_3OH$$

In one embodiment of the invention, the electrolysis is performed in the presence of hydrogen gas. Preferably, the cathode comprises a metal having activity as a hydrogenation catalyst, e.g., Pd, Pt, Au, Ir, Co, Rh, Ag, graphite or a combination thereof. Most preferably, the cathode comprises Pd or Pt.

In one embodiment of the invention, a regeneratable redox species is present in the vicinity of the cathode. A regeneratable redox species is a molecule which can be reduced electrolytically to a species capable of transferring an electron to another species, thereby regenerating the original molecule. Examples of regeneratable redox species include polycyclic aromatic hydrocarbons, e.g., naphthalene, 1- and 2-alkylnaphthalenes, anthracene, 1- and 2-alkylanthracenes, phenanthrene, chrysene, isoquinoline and combinations thereof. Most preferably, the regeneratable redox species is naphthalene or a 1- or 2-alkylnaphthalene. Preferred cathode materials for use in combination with a regeneratable redox species include carbon and graphite in various forms, including solid, cloths and felts and vitreous carbon. Preferably, when a regeneratable redox species is used, the water content of the solvent is less than 0.1%.

In one embodiment of the invention, the electrolytic reaction occurs in a non-aqueous solvent in which borohydride is soluble, e.g., $C_1$-$C_4$ aliphatic alcohols, e.g., methanol, ethanol; ammonia; $C_1$-$C_4$ aliphatic amines; glycols; glycol ethers; and polar aprotic solvents, for example, dimethylformamide (DMF), dimethylacetamide (DMAc), dimethyl sulfoxide, hexamethyl phosphoramide (HMPA), and combinations thereof. Preferably, the non-aqueous solvent is methanol, ethanol, DMF, HMPA, or combinations thereof Preferably, the amount of water present in non-aqueous solvents is less than 1%, more preferably less than 0.1%, more preferably less than 100 ppm, and most preferably the non-aqueous solvents are substantially free of water.

In another embodiment, the electrolytic reaction occurs in an aqueous solvent or an aqueous/organic solvent mixture having more than 1% water. Organic solvents used in an aqueous/organic solvent mixture are those having sufficient solubility in water to form a solution.

Preferably, when protic solvents are used, especially water, methanol or ethanol, alkali is present to stabilize the borohydride, preferably at least 0.1 N alkali.

In one embodiment in which HMPA is used as a solvent, preferred cathode materials include include carbon and graphite in various forms, including solid, cloths and felts and vitreous carbon.

In one embodiment of the invention, the non-aqueous solvent contains relatively unreactive salts that are soluble in the solvent, e.g., perchlorate salts, lithium p-toluenesulfonate, lithium methanesulfonate, lithium or sodium tetrafluoroborate and tetraalkylammonium salts of similar anions.

Disproportionation of a trialkoxyborohydride may occur as a competing reaction with electrolysis. Disproportionation occurs as described by the following equation for STB.

$$4NaBH(OCH_3)_3\rightarrow NaBH_4+3NaB(OCH_3)_4$$

Some borohydride is inevitably generated by this process. In the case of the first entry in Table 1, which reports a current efficiency of 400%, some of the borohydride clearly was generated in this way. This experiment started with 0.0117 moles of STB, giving a theoretical yield from disproportionation of 0.0029 moles of SBH. Results of titration with iodine solution indicated that 0.0034 moles of SBH actually formed. Therefore, 0.0034-0.0029, or 0.0005 moles of SBH must be attributed to electrolysis. Based on theoretical and actual coulombs passed, the actual current efficiency was 60%.

Electroreduction of trialkoxyborohydride to borohydride can be favored over the competing disproportionation reaction by several means. The choice of reaction solvent can influence the reaction pathway. Alkaline methanol produces a higher yield than HMPA. Mixed alcohol/amine or water/amine solvents also reduce disproportionation. The amount of alkali is also significant, with higher levels favoring disproportionation; it is preferred to use only sufficient alkali to stabilize the boron hydride reactants and products. Table 3 describes time-dependent disproportionation results for a series of solutions containing 10% alkali. Hindered alkyl groups in the trialkoxyborohydride also may reduce disproportionation, e.g., isopropyl, t-butyl or trimethylolpropyl.

Trialkoxyborohydrides may be prepared from a metal hydride and a trialkyl borate, as illustrated below for STB:

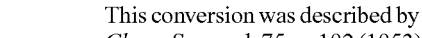

$$NaH+B(OCH_3)_3 \rightarrow NaBH(OCH_3)_3$$

This conversion was described by H. C. Brown et al., in *J. Am. Chem. Soc.*, vol. 75, p. 192 (1953) and *J. Am. Chem. Soc.*, vol. 79, p. 5400 (1957). The reaction occurs rapidly in the absence of solvent to produce STB. Alternatively, trimethoxyborohydride may be prepared by electrolysis of a borate ester.

The trialkoxyborohydride solution produced from a borate may be electrolyzed directly to SBH, optionally under conditions different from those used to produce the trialkoxyborohydride, or the trialkoxyborohydride solution may be removed from the electrolytic cell and converted to SBH in a different electrolytic cell. Preferably, electrolysis to produce trialkoxyborohydride is performed in a polar aprotic solvent, e.g., DMF. Optionally, an alkali metal chlorate or fluoroborate is present. Preferred cathode materials include graphite and nickel.

EXAMPLES

General procedure for STB electrolysis to SBH—A frit-divided glass H-cell consisting of three compartments (anolyte, catholyte and reference) with corresponding glass covers was fitted with a cathode and a graphite rod anode (5 $cm^2$ electrode area) with the remaining electrode area exposed to the solution masked with PTFE tape. A saturated calomel reference electrode was inserted into the reference compartment. Catholyte solution was added to the catholyte compartment, and solutions of 10 wt. % aqueous sodium hydroxide were added to the anode compartment (35 mL) and the reference compartment (10 mL). The electrodes were connected to a potentiostat system consisting of an Electrosynthesis Co. 410 potentiostat, 420 A DC power supply, and 640 coulometer. The cell was suspended in a room temperature water bath to maintain a constant temperature, and a magnetic stirrer was utilized to keep the cathode compartment well-stirred. The potential and initial current for the working electrode (cathode) were then set.

Procedure for electrolysis of STB to SBH with measurement by NMR (last two entries in Table 1—(A) The general procedure given above was followed, with a catholyte of 100 mL of 10% sodium hydroxide and 2 g STB. The potential for the cathode was set at −1.5 V vs. the calomel reference. The initial current was 550 mA (110 mA/$cm^2$ current density). After 7225 coulombs of charge were passed (0.0750 moles of electrons) at constant potential, the reaction was stopped. Based on a six-electron process for the production of sodium borohydride, up to 12.5 mmol of sodium borohydride could be formed at 100% efficiency. To define the actual concentration of sodium borohydride in the reaction mixture, a calibration curve was generated with a series of potassium borohydride samples of different concentrations using boron-11NMR peak intensities. A straight line calibration was obtained in the concentration range of 4.5 mmol/L to 13.5 mmol/L. Based on this curve, the concentration of the experimental sample was 18.3 mmol/L. This corresponds to 1.83 mmol total SBH and indicates a current efficiency of 15%.

(B)—A membrane-divided glass H-cell was used in this experiment in place of the frit-divided cell, as described in Table 1. The general procedure given above was followed, with a catholyte of 100 mL of 10% sodium hydroxide and 2 g STB. The potential for the cathode was set at −1.3 V vs. the calomel reference electrode. The initial current was 500 mA (100 mA/$cm^2$ current density). After 2500 coulombs of charge were passed (0.0259 moles of electrons) at constant potential, the reaction was stopped. Based on a six-electron process for the production of sodium borohydride, up to 4.3 mmol of sodium borohydride could be formed at 100% efficiency. To define the actual concentration of sodium borohydride in the reaction mixture, a calibration curve was generated with a series of potassium borohydride samples of different concentrations using boron-11 NMR peak intensities, as described in (A) above. Based on this curve, the concentration of the experimental sample was 20.2 mmol/L. This corresponds to 2.02 mmol total SBH and indicates a current efficiency of 47%.

Further results are tabulated in Tables 1-3. Table 1 describes experiments where borohydride was produced. Borohydride analysis for entries 1-3 and 8 was accomplished via quenching an aliquot of the product solution with an excess of standard iodine solution, followed by titration of the remaining iodine with standard bisulfite solution. The presence of borohydride product for entries 1-8 was confirmed via $^{11}B$ NMR analysis. Borohydride analysis for entries 9-19 was accomplished via $^{11}B$ NMR analysis comparing to known standard borohydride solutions. Table 2 describes a number of experiments which resulted in no borohydride. Table 3 describes a series of control experiments showing the disproportionation of STB to borohydride over time without electrolysis.

Conversion of trimethylborate (TMB) to STB—A frit-divided glass H-cell consisting of three compartments (anolyte, catholyte and reference) with corresponding glass covers was fitted with a cathode and a graphite rod anode (5 $cm^2$ electrode area) with the remaining electrode area exposed to the solution masked with PTFE tape. A saturated calomel reference electrode was inserted into the reference compartment. The catholyte was 0.5 M lithium perchlorate, 5 mL TMB (4.6 g, 44.3 mmol) in 100 mL DMF. The anolyte was 0.5 M lithium perchlorate/DMF (35 mL). The electrodes were connected to a potentiostat system consisting of an Electrosynthesis Co. 410 potentiostat, 420 A DC power supply, and 640 coulometer. The cell was suspended in a room temperature water bath to maintain a constant temperature, and a magnetic stirrer was utilized to keep the cathode compartment well-stirred. The controlled potential was set at −3.90 V, the initial current was 150 mA, and the charge passed was 1390 coulombs. In a second experiment, a nickel flag cathode (5 $cm^2$) attached to a nickel rod was used. The controlled potential was set at −3.5 V, the initial current at 85 mA and the charge passed was 1054 coulombs. Boron NMR analysis showed the presence of a doublet at about 0.17 ppm, in the area expected for a boron hydride species, but not at the location expected for borohydride.

TABLE 1

| Solvent/electrolyte/cathode | Potential/ coulombs | Analysis |
|---|---|---|
| .1 M BP/HMPA/5 g $LiClO_4$/1 g naph/1.5 g STB/$H_{2(g)}$/Gr | −5.0/495 | 34 mM $BH_4$— (CE = 400%) |
| .1 M BP/(.5 M KOH/$CH_3OH$)/5 g $NaClO_4$/1.5 g naph/1.5 g STB/$H_{2(g)}$/Ni | —/1502 | 7 mM $BH_4$— (CE = 27%) |
| .1 M BP/(.5 M KOH/$CH_3OH$)/5 g $NaClO_4$/1.5 g naph/1.5 g STB/Ni | −2.06/3000 | 5 mM $BH_4$— (CE = 10%) |
| .1 M BP/(50% DMF/$CH_3OH$)/5 g $NaClO_4$/1.5 g naph/1.5 g STB/Pt | −2.61/2025 | + |

TABLE 1-continued

| Solvent/electrolyte/cathode | Potential/ coulombs | Analysis |
|---|---|---|
| .1 M BP/(50% DMF/$CH_3OH$)/5 g $NaClO_4$/1.5 g naph/1.5 g STB/Ni | −3.05/3413 | + |
| (.5 M KOH/$CH_3OH$)/1.08 g naph/.8914 g STB/$H_{2(g)}$/Pd | —/319.8 | + |
| (.5 M KOH/$CH_3OH$)/1.01 g naph/1.01 g STB/$H_{2(g)}$/Pd | —/960.2 | + |
| (3 M KOH/$H_2O$)/1.0 g STB/$H_{2(g)}$/Pd | —/315 | 3.6 mM $BH_4$— (CE = 99%) |
| 1 g $(CH_3)_4NOH$/(50% DMF/ $CH_3OH$)/1 g naph/1 g STB/Pt | −2.0/940 | 2.6 mM $BH_4$— (CE = 16%) |
| 1 g $(CH_3)_4NOH$/(50% DMF/ $CH_3OH$)/1 g naph/1 g STB/Ni | −2.1/1449 | 3.8 mM $BH_4$— (CE = 15%) |
| .1 M BP/(10% NaOH/$H_2O$)/5 g $NaClO_4$/1 g naph/2 g STB/Pd | −2.0/4909 | 16.6 mM $BH_4$— (CE = 20%) |
| 2.1 g STB/(10% NaOH/$H_2O$)/Pd | −2.5/4507 | 20.9 mM $BH_4$— (CE = 30%) |
| 2 g STB/(10% KOH/$CH_3OH$)/Pd | −2.6/4005 | 13.5 mM $BH_4$— (CE = 20%) |
| 2 g STB/(10% NaOH/$CH_3OH$)/Pd | −2.75/4555 | 18.2 mM $BH_4$— (CE = 23%) |
| 2 g STB/(10% KOH/$H_2O$)/Pd | −2.0/4460 | 18.6 mM $BH_4$— (CE = 24%) |
| 2 g STB/(10% KOH/$CH_3OH$)/Ni | −1.8/4600 | 24.7 mM $BH_4$— (CE = 31%) |
| 2 g STB/(10% KOH/$H_2O$)/Ni | −2.0/5001 | 16.9 mM $BH_4$— (CE = 20%) |
| 2 g STB/(10% NaOH/$H_2O$)/Ni | −1.5/7225 | 18.3 mM $BH_4$— (CE = 15%) |
| 2 g STB/(10% NaOH/$H_2O$)/Ni* | −1.3/2500 | 20.2 mM $BH_4$— (CE = 47%) |

*Electrolyzed in a membrane divided cell (DuPont NAFION 324 cation exchange membrane)
Notes:
BP = tetra-n-butylammonium perchlorate;
naph = naphthalene;
Gr = graphite;
CE = current efficiency

TABLE 2

Results Showing no Borohydride Formation from STB

| Solvent/electrolyte/cathode | Potential/ coulombs |
|---|---|
| .1 M BP/$CH_3CN$/1 g $LiClO_4$/1 g naph/1 g STB/$H_{2(g)}$/Pd | −3.0/2990 |
| .1 M BP/$CH_3CN$/1.2 g $LiClO_4$/1 g anth/1 g STB/$H_{2(g)}$/Pd | −4.0/2803 |
| .1 M BP/$CH_3CN$/5 g $LiClO_4$/1 g naph/2 g STB/$H_{2(g)}$/Gr | −5.0/285 |
| .1 M BP/DMF/5 g $LiClO_4$/1 g naph/1.5 g STB/$H_{2(g)}$/Gr | −5.0/1800 |
| .1 M BP/DMF/5 g $LiClO_4$/1.2 g naph/1 g STB/$H_{2(g)}$/Pt | −5.0/1293 |
| .1 M BP/DMF/5 g $LiClO_4$/1.2 g naph/1 g STB/$H_{2(g)}$/Gr | −5.0/3000 |
| .1 M BP/(.5 M KOH/$CH_3OH$)/5 g $NaClO_4$/1.5 g naph/1.5 g STB/$H_{2(g)}$/Pt | —/4755 |
| .1 M BP/(.5 M KOH/$CH_3OH$)/5 g $NaClO_4$/1.5 g naph/1.5 g STB/Pt | —/3367 |
| .1 M BP/(.5 M KOH/$CH_3OH$)/5 g $NaClO_4$/1.5 g naph/1.5 g STB/$H_{2(g)}$/Gr | −2.67/3000 |

TABLE 2-continued

Results Showing no Borohydride Formation from STB

| Solvent/electrolyte/cathode | Potential/ coulombs |
|---|---|
| .1 M BP/(.5 M KOH/$CH_3OH$)/5 g $NaClO_4$/1.5 g naph/1.5 g STB/Gr | —/3003 |
| .1 M BP/(75% $CH_3OH$/HMPA)/5 g $NaClO_4$/1.5 g naph/1.5 g STB/Pt | —3.15/2025 |
| .1 M BP/(75% $CH_3OH$/HMPA)/5 g $NaClO_4$/1.5 g naph/1.5 g STB/Ni | —3.25/1000 |
| (1.07 4M NaOH/$CH_3OH$)/2.12 g naph/1.02 g STB/Pd | —/500 |

Notes:
B = Ptetra-n-butylammonium perchlorate;
naph = naphthalene;
Grgraphite;
anth = anthracene

TABLE 3

Controls and Disproportionation Percentages, No Electrolysis, Room Temperature

| Electrolyte | Time | Cathode | Analysis | Disprop. |
|---|---|---|---|---|
| 2 g STB/10% KOH-$H_2O$ | 48 hrs. | none | 38.7 mM | 100% |
| 2 g STB/10% NaOH-$H_2O$ | 0 | none | 24.4 mM | 62% |
| 2 g STB/10% NaOH-$H_2O$ | 3 hrs. | none | 34.3 mM | 88% |
| 2 g STB/10% NaOH-$H_2O$ | 12 hrs. | none | 39.3 mM | 100% |
| 2 g STB/10% NaOH-$H_2O$ | 0 | Pd | 21.2 mM | 54% |
| 2 g STB/10% NaOH-$H_2O$ | 3 hrs. | Pd | 22.8 mM | 58% |
| 2 g STB/10% NaOH-$H_2O$ | 12 hrs. | Pd | 23.3 mM | 60% |
| 2 g STB/10% NaOH-$CH_3OH$ | 0 | none | 8.3 mM | 21% |
| 2 g STB/10% NaOH-$CH_3OH$ | 3 hrs. | none | 19.9 mM | 51% |
| 2 g STB/10% NaOH-$CH_3OH$ | 12 hrs. | none | 21.5 mM | 55% |
| 2 g STB/10% NaOH-$CH_3OH$ | 0 | Pd | 39.7 mM | 100% |
| 2 g STB/10% NaOH-$CH_3OH$ | 3 hrs. | Pd | 37.6 mM | 96% |
| 2 g STB/10% NaOH-$CH_3OH$ | 12 hrs. | Pd | 28.5 mM | 73% |

The invention claimed is:

1. A method for producing borohydride said method comprising causing current to flow in an electrolytic cell between an anode and a cathode, wherein the cathode comprises palladium or nickel, wherein a solution of trimethoxyborohydride or triethoxyborohydride is in contact with the cathode, wherein said solution of trimethoxyborohydride or triethoxyborohydride comprises at least one solvent selected from the group consisting of methanol and water; and at least 0.1 N alkali, wherein a regeneratable redox species is present in the vicinity of the cathode, and in which the regeneratable redox species is selected from the group consisting of naphthalene, 1-alkylnaphthalenes and 2-alkylnaphthalenes.

* * * * *

UNITED STATES PATENT AND TRADEMARK OFFICE

CERTIFICATE OF CORRECTION

PATENT NO. : 7,638,029 B2
APPLICATION NO. : 11/104121
DATED : December 29, 2009
INVENTOR(S) : Guilbault et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1296 days.

Signed and Sealed this

Ninth Day of November, 2010

David J. Kappos

David J. Kappos
*Director of the United States Patent and Trademark Office*